United States Patent [19]

Larson

[11] Patent Number: 5,044,772

[45] Date of Patent: Sep. 3, 1991

[54] FLEXIBLE BAG WITH SUPPORTING AND SEALING TAPE

[75] Inventor: Curtis L. Larson, Hudson, Minn.

[73] Assignee: Minnesota Mining and Manufacturing Company, St. Paul, Minn.

[21] Appl. No.: 43,488

[22] Filed: Apr. 28, 1987

[51] Int. Cl.[5] ..... B65D 27/14; B65D 33/18

[52] U.S. Cl. ..... 383/11; 229/80; 383/93

[58] Field of Search ..... 206/806, 632; 383/35, 383/93, 95, 903, 11; 229/80

[56] References Cited

U.S. PATENT DOCUMENTS

| | | | |
|---|---|---|---|
| 576,388 | 2/1897 | Wheeler | 229/80 X |
| 2,000,188 | 5/1935 | Poppe | 383/35 X |
| 2,066,495 | 1/1937 | Swift | 229/80 |
| 2,777,491 | 1/1957 | Ashton et al. | 383/75 |
| 2,811,280 | 10/1957 | Commisso et al. | 206/806 X |
| 3,070,280 | 12/1962 | Richmond | 206/632 X |
| 3,151,803 | 10/1964 | Kaminski | 229/80 |
| 3,279,331 | 10/1966 | Platt | 383/86 X |
| 3,508,700 | 4/1970 | Kelly | 206/806 X |
| 3,549,085 | 12/1970 | Hart | 383/86 X |
| 3,653,583 | 4/1972 | Meyer | 383/75 X |
| 3,945,559 | 3/1976 | Krautsack | 206/806 X |
| 3,970,130 | 7/1976 | Casey | 383/903 X |
| 4,165,832 | 8/1979 | Kuklies et al. | 383/903 X |
| 4,394,955 | 7/1983 | Raines et al. | 383/86 |
| 4,581,007 | 4/1986 | Kamp | 493/264 |
| 4,633,508 | 12/1986 | Sanders | 383/95 |

FOREIGN PATENT DOCUMENTS

| | | | |
|---|---|---|---|
| 1369158 | 6/1964 | France | 383/106 |

*Primary Examiner*—Stephen P. Garbe

*Attorney, Agent, or Firm*—Gary L. Griswold; Walter N. Kirn; Mark W. Binder

[57] ABSTRACT

This invention relates to a flexible bag having a front panel and back panel forming the envelope with the same joined at the bottom and sides thereof has a strip of pressure-sensitive adhesive tape adhered by the adhesive to the inner surface of the front panel with a portion thereof extending above the front panel. The exposed adhesive on the tape affords means for adhering the bag to the edge of a counter or surface, and the same will form means for securing a flap on the bag over the opening. Notches at the sides of the bag adjacent the opening permit greater separation of the front and back panels to increase the size of the opening without separation of the tape.

3 Claims, 2 Drawing Sheets

FLEXIBLE BAG WITH SUPPORTING AND SEALING TAPE

BACKGROUND OF THE INVENTION

1. Field of the Invention

This invention relates to an improvement in plastic bags, and in one aspect, to an improved construction of a bag for refuse which includes a closure member to position the bag during use and to seal the bag when filled.

2. Description of the Prior Art

There are many constructions of flexible bags which are made of plastic material and provided with some type of pressure-sensitive adhesive, making the same easy to close. A number of variations of a bag having a reusable pressure-sensitive adhesive closure for the opening are disclosed in United Kingdom patent application 2,066,208. The bag therein disclosed, which are most relevant to the pesent invention, is a bag as illustrated in FIG. 22 comprising a back panel having a front surface and a rear surface and a front panel having a front surface. The back panel and the front panel are contiguous and extend beyond a bottom fold. The dimension of the back panel upwardly from the bottom fold is greater than the dimension of the front panel in the same direction, and provides a flap extending forwardly and downwardly of the front panel. The front surface of the front panel is provided with a strip of pressure-sensitive adhesive which is a reusable adhesive placed across the front surface of the front panel to adhere to the inside surface of the flap formed on the back panel. This construction permits the flap to be peeled from the front panel to provide access to the opening of the bag which is otherwise sealed on the two sides and formed with the folded bottom.

Other relevant bag constructions are shown in U.S. Pat. No. 4,502,599, assigned to the assignee of this application, U.S. Pat. No. 3,561,670, disclosing a bag having a band of adhesive covered by a protective strip on the rear surface of the back panel adjacent its upper edge for adhering the bag to a support member for the same to serve as a receptacle; and U.S. Pat. No. 2,715,493 and No. 2,671,602, showing bags with strips of adhesive used to join the bags and subsequently seal the bags.

The improvement of the present invention over that of the prior art is the provision of a piece of pressure-sensitive adhesive tape having adhesive on one surface being applied to the back face of the front panel of a flexible bag adjacent the bag opening with a portion of the adhesive of said strip of tape being exposed on the front of the bag above the front panel.

The bag of the present invention is provided with a notch in each side to facilitate a wider opening in the top of the bag during filling.

The present invention provides an improvement over prior flexible bags having a pressure-sensitive adhesive closure in that a single piece of tape is adhered along one portion thereof to the inner face of the front panel of the bag and a release member is adhered over a portion of the adhesive face of the tape which release member is removable to expose the adhesive face of the tape above the front panel, allowing the same to be affixed to an object. The adhesive also forms the resulting seal for the flap.

The present invention is an improvement over previous bags having a pressure-sensitive adhesive closure in that the adhesive closure is formed on the front panel of the bag, permitting the front panel of the bag to be adhered to a surface over which material may be moved to be placed into the bag and then the bag may be removed from the surface and the projecting flap on the back panel of the bag may be folded over the front panel and secured thereto by the same strip of pressure-sensitive adhesive.

SUMMARY OF THE INVENTION

The present invention is directed to a flexible bag comprising a back panel having a front surface and a rear surface and a front panel and having a front surface and a rear surface. The back panel and the front panel are contiguous. The dimension of the back panel upwardly from the bottom is greater than the dimension of the front panel to provide a flap extending beyond the upper edge of the front panel. The front panel and the back panel are welded together in side seams along the contiguous edges. The bottom is sealed or formed with a fold. A strip of pressure-sensitive adhesive tape having adhesive coated on one surface thereof is positioned along the upper edge of the rear surface of the front panel with a predetermined portion of the adhesive surface of the tape being exposed above the surface of the front panel.

A removable strip is applied to the adhesive portion of the length of tape extending above the front panel. This removable strip may be a release liner or may comprise a portion of the bag material forming the front panel but slit or perforated along the length of the strip of pressure-sensitive adhesive tape, permitting the portion of bag material to be removed to expose a portion of the pressure-sensitive adhesive tape and define the upper surface of the front panel of the bag.

A notch is formed in each side or edge of the bag adjacent the opening to afford a larger opening at the open side of the envelope.

BRIEF DESCRIPTION OF THE DRAWINGS

The present invention will be further described in reference to the accompanying drawing wherein.

DETAILED DESCRIPTION

Figure 1:
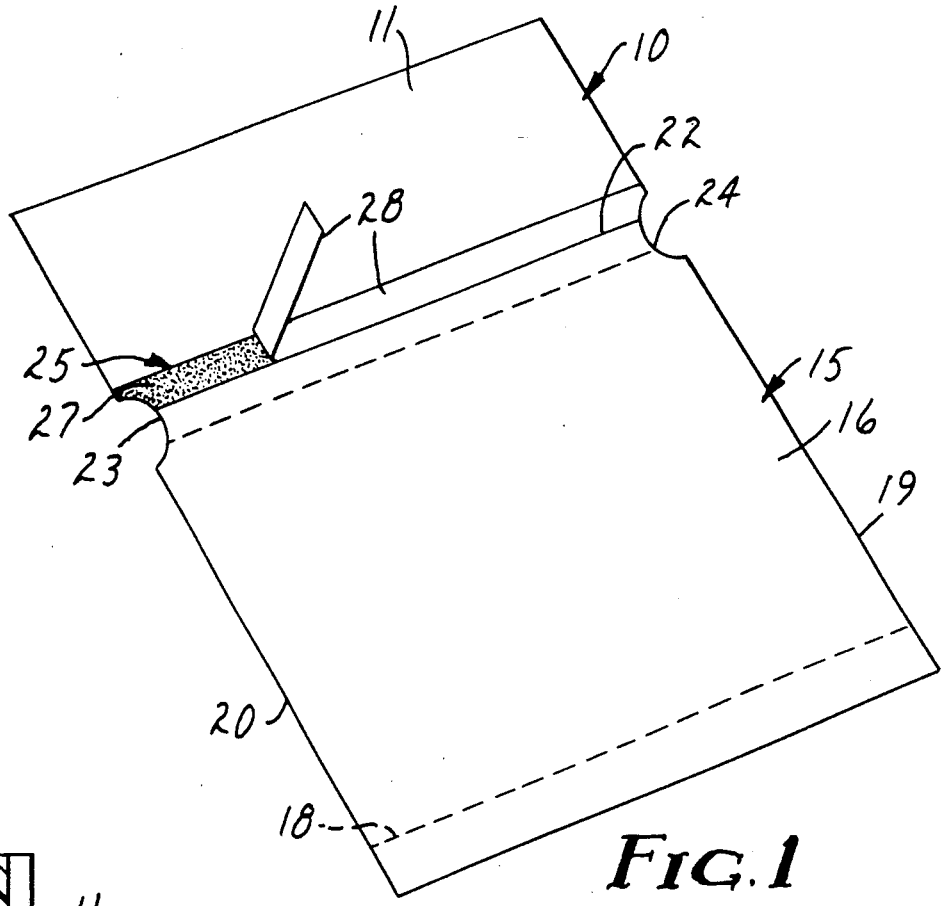
FIG. 1 is a perspective view of a bag formed in accordance with the present invention.
Figure 2:
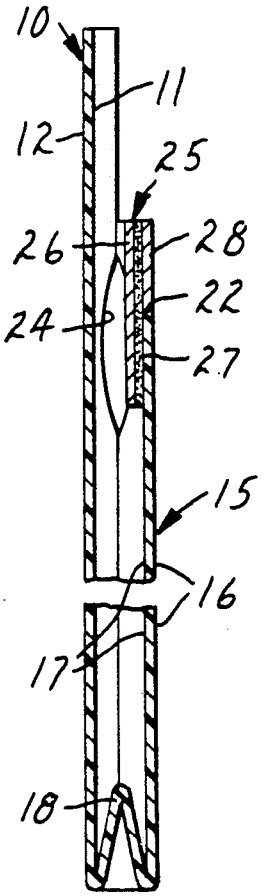
FIG. 2 is a vertical sectional view of a bag according to the present invention.

The present invention provides an improved flexible bag for use in collecting refuse such as from a sink or counter and is particularly adapted for use with sinks or counters where no garbage disposal is provided. The bag may also be attached to other surfaces for a variety of other uses. The present invention provides a bag which may be readily adhered to a lip of a counter or sink on which food is prepared and then the refuse may be moved across the lip and into the open bag against the front face of the back panel of the bag and slid into the bag. The bag is then removed from the lip and the flap closed over the front panel and adhered by the same adhesive used to seal the bag to the lip. The strip of tape adhering the bag to the article reduces the chance for scraps or refuse to collect between a portion of the front face of the bag and the tape as the tape masks the top of the front panel.

Referring now to the drawing there is shown a bag according to the present invention having a back panel 10 having a front surface 11 and a rear surface 12. A front panel 15 comprises a front surface 16 and a rear surface 17. The back panel and the front panel are contiguous and extend through a bottom multiple fold which provides a gusset or tuck 18 at the bottom of the bag. The contiguous sides of the bag are welded together to form side seals 19 and 20. The dimension of the back panel 10 upwardly from the bottom is greater than the front panel 15 to extend above an edge or line 22 forming the upper edge of the front panel 15. This greater dimension of the back panel provides a flap which can be folded over the front panel.

A strip of pressure-sensitive adhesive tape 25 comprising a backing 26 and a layer of pressure-sensitive adhesive 27 is applied to the inside or rear surface 17 of the front panel 15 with a portion of the width of the strip of tape 25 extending above the line 22. A cover member 28 is adhered to the portion of the strip of adhesive tape which is not adhered to the back surface 17 of the front panel 15 to protect the adhesive until its use is desired. This cover strip 28 may be a strip of release liner which is equal to the width of the tape exposed or it may be of greater width to permit its facile release.

A pair of notches 23 and 24, are formed at the side of the front panel adjacent the ends of line 22, or in both panels as illustrated. These notches or cut-out portions 23 and 24, which are illustrated as semicircular, interrupt the seals 19 and 20 at the sides of the panels 10 and 15 to permit the back panel to be separated from the front panel adjacent the line 22 of the front panel when the same is adhered to a surface to permit easier access to the interior of the commonly constructed plastic bag to afford an opening having a shape other than circular or triangular shaped. The notches extend preferably below the edge of the tape and may have any shape to afford an expanded opening. The notches are formed with arcuate edges to reduce the possibility of stress areas where tears can start.

Figure 3:
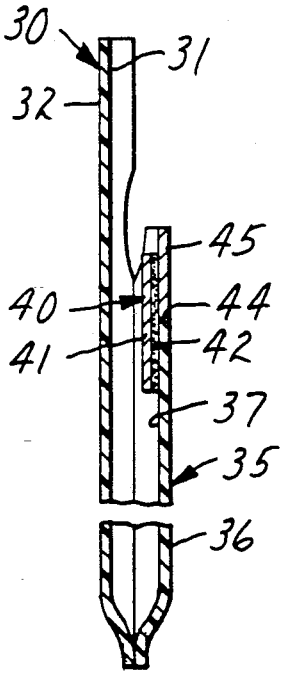
FIG. 3 is a vertical fragmentary sectional view of another embodiment of the bag of the present invention.

The second embodiment is shown in FIG. 3 wherein the back panel 30 having a front surface 31 and a back surface 32 is formed as part of a bag with a front panel 35 comprising a front surface 36 and a rear surface 37. The front panel and the back panel are sealed (as shown) or folded to form a bottom. A strip of pressure-sensitive adhesive tape 40 having a backing 41 and a layer of pressure-sensitive adhesive 42 is adhered by the pressure-sensitive adhesive coated surface to the rear surface 37 of the front panel 35 with a portion of the adhesive extending above a separation line 44 representing the top of the front panel 35. The separation line 44 may be a slit, a series of slits or perforations or weakened line. A release portion 45 extends above the front panel 35 and is removable along line 44. This release panel 45 may be formed of the same material and as a portion of the front panel 35 and is removable from the pressure sensitive coated surface 42 of the tape 40. The adhesive and material permits the bag to be reclosable as the adhesive will peel from the flap similar to the portion 45.

Figure 4:
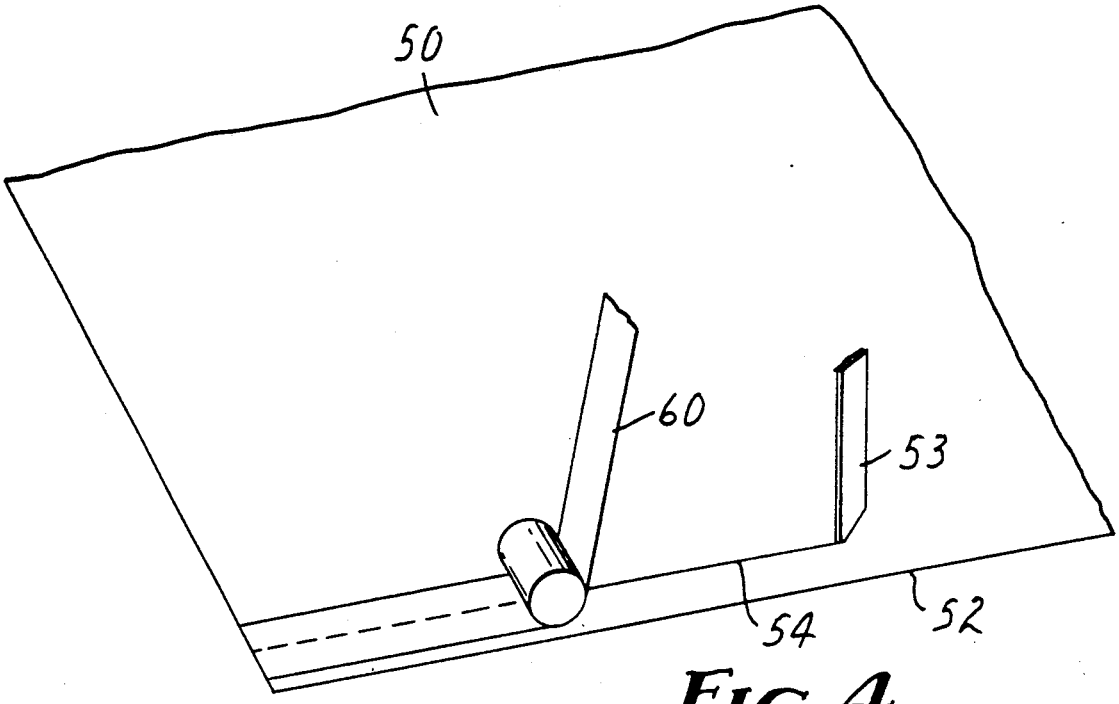
FIG. 4 diagrammatically illustrates the method of manufacture of the bag of FIG. 3.

As illustrated in FIG. 4, the bag of FIGS. 1 or 3 is formed by taking a web 50 of flexible plastic material and slitting the same by a cutter 53 to form a slit 54 that corresponds to the line 44. Over this slit 54 is applied a strip of pressure-sensitive adhesive tape 60, with the adhesive surface being applied to the web 52 and the center of the pressure-sensitive adhesive tape 50 being disposed to cover the slit 54. The web 50 then proceeds to a web folding station wherein the web is formed into the front panel and the back panel and then the bag is formed by transverse cuts and a seal at the edges of the cuts to form the sides of the bags.

Figure 5:
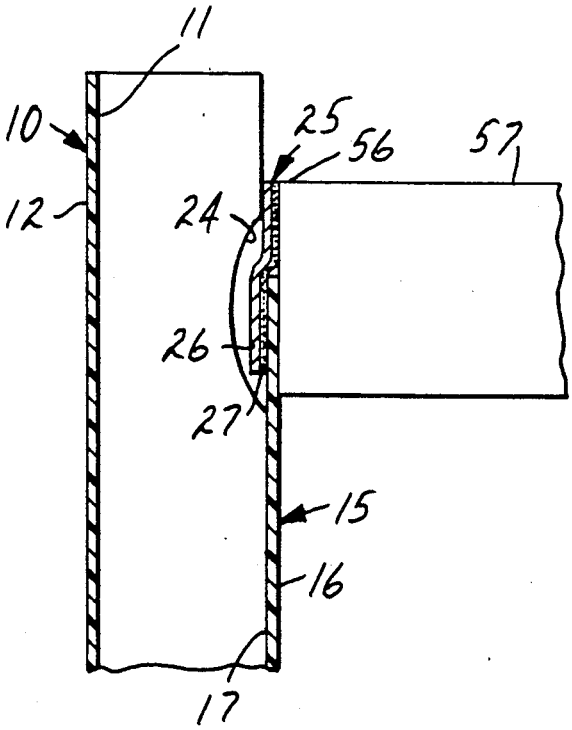
FIG. 5 discloses the bag of the present invention in use.

FIG. 5 illustrates the use of the bag of FIG. 1. As illustrated, the bag is disposed with the liner 28 removed, and the adhesive-coated surface 27 of the adhesive tape 25 being applied to the lip 56 of a counter 57. The notch 24 along one side of the bag permits the same to be opened to increase the width of the throat of the bag. Contents from the counter 57 may then be wiped across the lip 56 and the upper edge of the tape 25 into the bag. The bag can then be removed by stripping the bag and the tape 25 from the lip 56 and folding the flap on the back panel 11 of the bag over the top of the pressure-sensitive adhesive tape 25 and sealing the front face 11 of the back panel 10 onto the exposed strip of adhesive 27. The adhesive has been protected from contamination and will readily adhere to the flap of the bag.

Having thus described the present invention with reference to preferred embodiments thereof it will be understood that modifications may be made thereto without departing from the spirit or scope of the invention as defined in the appended claims.

We claim:

1. A bag comprisign a back panel having a front surface and a rear surface, a front panel having a front surface and a rear surface, the back panel and the front panel beign joined to form the bottom and sides of the bag, a strip of pressure-sensitive adhesive tape having a backing and an adhesive coated surface, said strip of pressure-sensitive adhesive tape being adhered to the rear surface of the front panel, and a line of weakening extending between side edges of said front panel for dividing said front panel into an upper portion that covers an upper portion of the adhesive coated surface of said strip of pressure-sensitive adhesive tape and a lower portion adhered to the remaining portion of the adhesive coated surface of said strip of pressuer-sensitive adhesive tape, and for permitting separation and removal of said upper portion of said front panel from said bag.

2. The bag of claim 1, wherein said line of weakening comprises a cut line extending between the side edges of said front panel.

3. The bag of claim 1, wherein said upper portion of said front panel extends upwardly beyond an uppermost edge of said strip of pressure-sensitive adhesive tape to facilitate easy removal of said upper portion.

* * * * *

UNITED STATES PATENT AND TRADEMARK OFFICE

CERTIFICATE OF CORRECTION

PATENT NO. : 5,044,772

DATED : September 3, 1991

INVENTOR(S) : Larson

It is certified that error appears in the above-identified patent and that said Letters Patent is hereby corrected as shown below:

Col. 4, line 38, "comprisign" should be --comprising--.

Col. 4, line 51, "pressuer" should be --pressure--

Signed and Sealed this

Sixth Day of April, 1993

*Attest:*

STEPHEN G. KUNIN

*Attesting Officer*

*Acting Commissioner of Patents and Trademarks*